US007481083B2

(12) United States Patent
Habu et al.

(10) Patent No.: US 7,481,083 B2
(45) Date of Patent: Jan. 27, 2009

(54) DRUM TYPE WASHING AND DRYING MACHINE

(75) Inventors: Satoshi Habu, Osaka (JP); Koji Nakai, Hyogo (JP); Takahiro Inoue, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 524 days.

(21) Appl. No.: 11/186,886

(22) Filed: Jul. 22, 2005

(65) Prior Publication Data

US 2006/0096334 A1 May 11, 2006

(30) Foreign Application Priority Data

Nov. 9, 2004 (JP) ..... 2004-324815

(51) Int. Cl.
*D06F 25/00* (2006.01)
*D06F 39/04* (2006.01)

(52) U.S. Cl. ..... 68/19.2; 68/20; 68/24; 34/596; 34/77

(58) Field of Classification Search ..... 68/19.2, 68/20, 19.1, 24; 34/596, 77
See application file for complete search history.

(56) References Cited

U.S. PATENT DOCUMENTS 3,314,254 A * 4/1967 Mandarino, Jr. et al. ..... 68/20
3,314,255 A * 4/1967 Neumann et al. ..... 68/20
3,707,856 A * 1/1973 Niewyk et al. ..... 68/12.03
3,866,333 A * 2/1975 Sarukahanian et al. ..... 34/75
4,154,003 A * 5/1979 Muller ..... 34/469
7,017,282 B2 * 3/2006 Pyo et al. ..... 34/596
7,275,399 B2 * 10/2007 Park et al. ..... 68/18 C
2004/0045327 A1 * 3/2004 Kim et al. ..... 68/19.2
2004/0065125 A1 * 4/2004 Asada et al. ..... 68/12.09
2004/0079121 A1 * 4/2004 Yabuuchi et al. ..... 68/19.2
2004/0103697 A1 * 6/2004 Kim et al. ..... 68/18 R
2005/0071929 A1 * 4/2005 Mani et al. ..... 8/158
2005/0081575 A1 * 4/2005 Park et al. ..... 68/18 C

FOREIGN PATENT DOCUMENTS

JP 11333185 12/1999

* cited by examiner

*Primary Examiner*—Joseph L Perrin
(74) *Attorney, Agent, or Firm*—Bacon & Thomas, PLLC

(57) ABSTRACT

A drum type washing and drying machine includes a rotary drum provided with drum perforations on the cylindrical surface thereof, a water tub elastically supported in a main body of the machine, for accommodating the rotary drum, a blower unit for circulating air into the rotary drum, a heating unit for heating the air to be circulated into the rotary drum, an air flow passage for directing air, which has been exhausted from the rotary drum into a space between the water tub and the rotary drum through the drum perforations, to the blower unit, a heat exchanging member installed in the air flow passage, and a cooling water supply unit for supplying cooling water to the heat-exchanging member. The heat-exchanging member is slantingly disposed in the air flow passage and has an upper and a lower surface and to form an approximately U-shaped heat exchanging path.

9 Claims, 4 Drawing Sheets

DRUM TYPE WASHING AND DRYING MACHINE

FIELD OF THE INVENTION

The present invention relates to a drum type washing and drying machine for performing washing, rinsing, water-extracting and drying processes sequentially in a rotary drum having a substantially horizontal or slanted rotational axis.

BACKGROUND OF THE INVENTION

A configuration of a conventional drum type washing and drying machine will be described hereinafter with reference to FIG. 4.

As shown in FIG. 4, main body 1 of the drum type washing and drying machine has therein water tub 3 supported by a suspension structure (not shown) and damper 2, and opening 4 of water tub 3 is opened and closed by a door (not shown). Further, rotary drum 5 provided with multiple drum perforations 7 and baffles 8 is rotably installed in water tub 3 and is driven by motor 6. Wash water supply valve 9 for supplying water into water tub 3 and cooling water supply valve 10 for supplying cooling water are installed in main body 1. Further, water outlet 11 is formed at water tub 3 and is connected to water drain conduit 13 via water drain pump 12.

An air circulation channel for a drying process for laundry in rotary drum 5 includes blower 14 for blowing air into water tub 3 through air injection port 15, heater 16 connected thereto, heat exchanger 17 disposed between water tub 3 and blower 14, and cooling water hose 18 directly connected to cooling water supply valve 10 and communicating with heat exchanger 17 (see, for example, Japanese Patent Laid-Open Application No. H11-333185).

Operation of the washing machine with the above configuration will now be described. When a washing process is initiated after loading laundry into rotary drum 5, wash water supply valve 9 is opened, so that fresh water is supplied in water tub 3 up to a predetermined water level. Thereafter, rotary drum 5 is driven to rotate at a rotation number of about 50 rpm. As a result of the rotation of rotary drum 5, the laundry in rotary drum 5 tumble and is lifted up by baffles 8 and then plunged into the water over and over. As the washing machine repeats this agitation process to loosen dirt, the laundry is cleaned by wash water with detergent dissolved therein and the repeated beating motions on the water surface. At the conclusion of the wash cycle, water drain pump 12 is driven, so that soiled wash water is drained via water drain conduit 13. After the soiled wash water is pumped out, a water-extracting process is performed by way of spinning rotary drum 5 with a rotation number of about 1000 rpm. After the water-extracting process, a drying process is started.

During the dry cycle, while the laundry accommodated in rotary drum 5 is agitated as a result of the rotation of rotary drum 5 as in the washing process, hot air heated by heater 16 is blown to the laundry in rotary drum 5 through air injection port 15 by blower 14. As a result, the residual moisture in the laundry in rotary drum 5 is evaporated by the hot air. Then, the hot and humid air with the moisture from the laundry is directed to heat exchanger 17 to be cooled down by cooling water supplied in heat exchanger 17. As a result, the hot and humid air is cooled and dehumidified because its moisture is condensed out. Then, the dehumidified air is heated again by heater 16 and is re-circulated into rotary drum 5 to further dry the laundry. By having this dry cycle, the washing and drying machine can dry the laundry in rotary drum 5.

In the conventional configuration of the washing machine, however, since heat exchanger 17 has an approximately hollow rectangular shape, heat exchanger 17 needs to be designed sufficiently large to ensure a satisfactory drying. However, the limited space in main body 1 is inadequate to accommodate the heat exchanger size requirement.

SUMMARY OF THE INVENTION

It is, therefore, an object of the present invention to provide a drum type washing and drying machine having a compact heat exchanger with a high drying efficiency.

In accordance with the present invention, there is provided a drum type washing and drying machine including: a cylindrical rotary drum provided with a plurality of drum perforations on the cylindrical surface thereof and having a rotating shaft in an approximately horizontal or slanted direction; a water tub elastically supported in a main body of the washing and drying machine, for accommodating the rotary drum therein; a blower unit for circulating air into the rotary drum; a heating unit disposed between the blower unit and the rotary drum, for heating the air to be circulated into the rotary drum; an air flow passage for directing air, which has been exhausted from the rotary drum into a space between the water tub and the rotary drum through the drum perforations of the rotary drum, to the blower unit; a plate-shaped heat exchanging member installed in the air flow passage; and a cooling water supply unit for supplying cooling water to the heat-exchanging member, wherein the heat-exchanging member is slantingly disposed in the air flow passage and has an upper and a lower surface to form an approximately U-shaped heat exchanging path.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described with reference to the accompanying drawings. Here, it is to be noted that the present invention is not limited thereto.

First Preferred Embodiment

Figure 1:
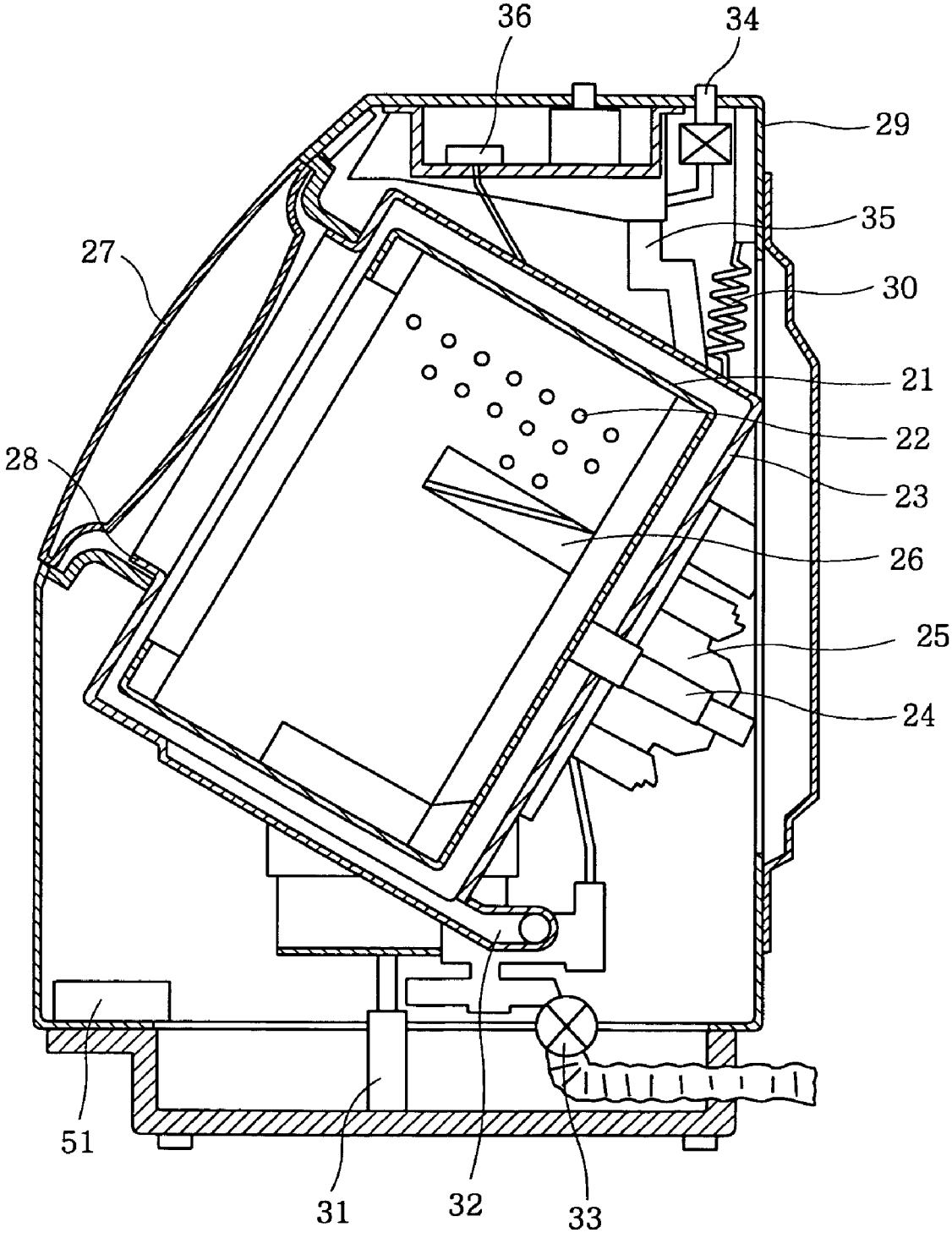
FIG. 1 presents a vertical cross sectional view of a drum type washing and drying machine in accordance with a first preferred embodiment of the present invention.
Figure 2:
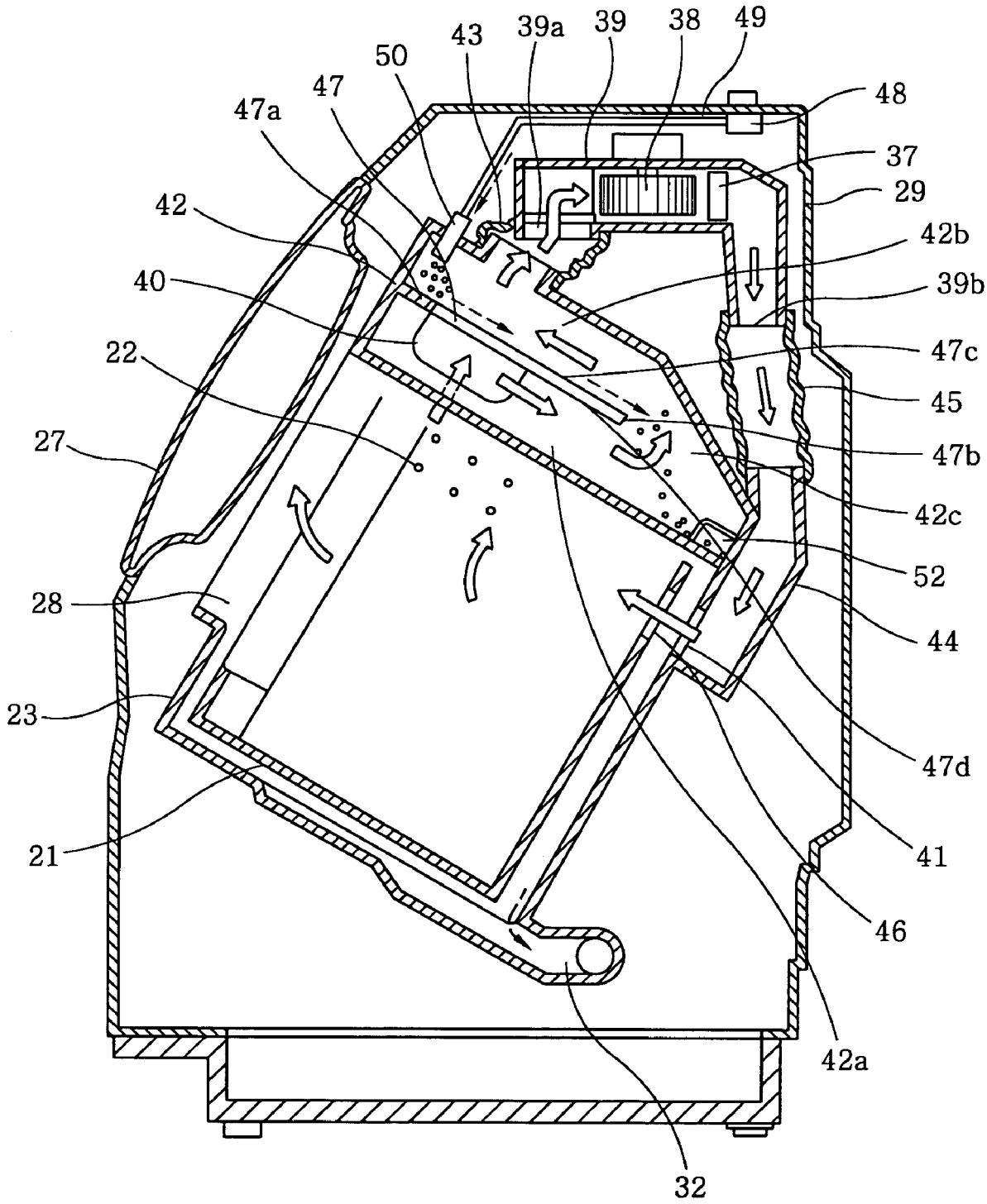
FIG. 2 sets forth another vertical cross sectional view of the drum type washing and drying machine in accordance with the first embodiment to illustrate a drying function thereof.

FIG. 1 provides a vertical cross sectional view of a drum type washing and drying machine in accordance with a first preferred embodiment of the present invention and FIG. 2 sets forth another vertical cross sectional of the washing and drying machine to illustrate a drying function thereof.

As shown in FIG. 1, cylindrical rotary drum 21 having a bottom surface is provided with multiple drum perforations 22 in its cylindrical wall and is rotably installed in water tub 23. Further, rotary drum 21 is also provided with rotating shaft 24 at its center of rotation and is disposed such that its rotational axis is declined toward a rear side of the washing and drying machine. Further, motor 25 installed at a rear side of water tub 23 is connected to rotating shaft 24 so that it is capable of rotating rotary drum 21 in forward and reverse direction. Further, multiple agitation blades 26 are disposed on the inner cylindrical surface of rotary drum 21.

An opening formed at the inclined surface of water tub 23's front portion which faces upward is opened and closed by door 27. By opening door 27, laundry can be loaded into or unloaded from rotary drum 21 through laundry loading/unloading opening 28. Since door 27 is installed in main body 29's sloped surface which faces upward, loading/unloading of laundry can be done without a user having to bend down considerably.

Water tub 23 is suspended in washing machine main body 29 by spring 30 and damper 31 such that it is allowed to vibrate or rock therein. Connected to the lower portion of water tub 23 is one end of water drain conduit 32, and the other end of water drain conduit 32 is connected to water drain valve 33 to drain wash water from water tub 23. Water supply valve 34 is used to fill water in water tub 23 via water supply conduit 35. Water level detector 36 detects a water level in water tub 23.

Further, in this preferred embodiment, although rotary drum 21 having rotating shaft 24 at its center of rotation is installed such that its rotational axis is declined toward the rear portion of the washing machine, rotary drum 21 can also be arranged up such that its rotational axis is approximately horizontal.

FIG. 2 illustrates a drying function provided by the drum type washing and drying machine.

An air circulation channel for the drying function includes heater (heating unit) 37, blower (blower unit) 38 and blower case (air flow passage) 39 accommodating heater 37 and blower 38 therein, wherein blower case 39 is installed in washing machine main body 29. Further, warm air outlet (air flow passage) 40 through which air in water tub 23 is exhausted into heat exchanging path 42 (air flow passage) is provided at a body portion of water tub 23, while warm air inlet 41 is provided at a rear side of water tub 23. Further, heat exchanging path 42 and water tub 23 are formed as one body, wherein one end of heat exchanging path 42 communicates with warm air outlet 40, while the other end thereof is connected to air suction opening 39*a* of blower case 39 via first bellows hose (air flow passage) 43. Meanwhile, air exhaust opening 39*b* of blower case 39 is connected to one end of rear air flow passage 44 via second bellows hose 45, wherein rear air flow passage 44 and water tub 23 are formed as one body and the other end of rear air flow passage 44 communicates with warm air inlet 41 of water tub 23. Further, air circulation hole 46 is provided at a rear side of rotary drum 21 to face warm air inlet 41 of water tub 23, so warm air introduced into water tub 23 via warm air inlet 41 is allowed to flow into rotary drum 21 through air circulation hole 46.

Plate-shaped heat-exchanging member 47 is installed in heat exchanging path 42 such that it is located above warm air outlet 40, while being declined toward the rear side of the washing and drying machine. Heat exchanging path 42 is divided into lower heat exchanging path 42*a* and upper heat exchanging path 42*b* by heat-exchanging member 47, wherein lower and upper heat exchanging path 42*a* and 42*b* communicate with each other via communication opening 42*c* which is provided in the vicinity of lower end portion 47*b* of heat-exchanging member 47. Accordingly, the heat exchanging path 42 has an approximately U-shape. Cooling water supply valve 48 (cooling water supply unit) supplies cooling water to upper end portion 47*a* of heat-exchanging member 47 via cooling water hose 49 and water supply nozzle 50 in order. Cooling water supply valve 48, cooling water hose 49 and water supply nozzle 50 jointly form a cooling water supply unit. Further, in this configuration, the cross section of upper heat exchanging path 42*b* is set to be larger than that of communication opening 42*c*.

A washing, rinsing, water-extracting and drying operation of the drum type washing and drying machine with the above configuration are performed under the control of controller 51.

Operation of the drum type washing and drying machine with the above configuration will be described hereinafter. Here, discussion of washing, rinsing and water-extracting processes will be omitted because they are identical to those of the conventional drum type washing and drying machine described earlier.

During a dry cycle, air directed into blower case 39 by the rotation of blower 38 is heated by heater 37, and the heated warm air at a preset temperature is blown into water tub 23 through warm air inlet 41 via second bellows hose 45 and rear air flow passage 44 in order and, then, is directed into rotary drum 21 through air circulation hole 46 as indicated by unfilled arrows. As the heated air travels through rotary drum 21, moisture contained in the wet laundry inside rotary drum 21 is evaporated by the heated air while being agitated, so that the warm air becomes humidified by the moisture from the laundry. Thereafter, the humid warm air is exhausted from rotary drum 21 into water tub 23 through drum perforations 22 and then is directed to heat exchanging path 42 via warm air outlet 40.

At this time, cooling water supply valve 48 is in an ON-status, so cooling water falls toward upper end portion 47*a* of heat-exchanging member 47 from water supply nozzle 50, flows down on upper surface 47*c* of heat-exchanging member 47, and drops downward into lower heat exchanging path 42*a* upon reaching the tip of lower end portion 47*b* of heat-exchanging member 47, as indicated by dotted arrows in FIG. 2. Thereafter, the cooling water falls down into water tub 23 via drain hole 52 provided at a bottom portion of lower heat exchanging path 42*a* to be drained out via water drain conduit 32.

The damp warm air directed into lower heat exchanging path 42*a* of heat exchanging path 42 through warm air outlet 40 first contacts lower surface 47*d* of heat-exchanging member 47. At this time, the cooling water flowing down on upper surface 47*c* of heat-exchanging member 47 cools down heat-exchanging member 47. Therefore, as the humid warm air travels through lower heat exchanging path 42*a* and contacts lower surface 47*d* of heat-exchanging member 47, it is first cooled down and dehumidified (first dehumidification process).

Then, when the partially dehumidified warm air is directed into upper heat exchanging path 42*b* from lower end portion 47*b* of heat-exchanging member 47 via communication opening 42*c*, the humid warm air runs into the cooling water falling from lower end portion 47*b* of heat-exchanging member 47. An impact from this process disperses the cooling water and the dispersed cooling water further cools down and dehumidifies the damp warm air for a second time (second dehumidification process).

Subsequently, the still humid warm air directed into upper heat exchanging path 42*b* contacts directly with the cooling water flowing down on upper surface 47*c* of heat-exchanging member 47. Here, the respective flowing directions of the cooling water and the damp warm air are opposite to each other, so an efficient cooling process takes place between the damp warm air and upper surface 47*c* of heat-exchanging member 47 and the cooling water flowing thereon (third dehumidification process).

As described, the damp warm air is efficiently cooled and dehumidified while it is subjected to the first, the second and the third dehumidification process in order. The resulting dehumidified air is then directed into blower case 39 through air suction opening 39*a* of blower case 39 via first bellows hose 43 and reaches blower 38.

In the above dehumidification processes, since the cross section of upper heat exchanging path 42*b* is larger than that of communication opening 42*c*, the flow velocity of the damp warm air in upper heat exchanging path 42*b* becomes slower than that in communication opening 42*c*, whereby dispersed cooling water is prevented from entering blower case 39 through air suction opening 39*a* thereof and is made to fall down on heat-exchanging member 47 along upper heat exchanging path 42*b*. Therefore, dispersed water droplets are prevented from reaching heater 37.

By circulating air as described above, wet laundry in rotary drum 21 is gradually dried, and, after the laundry is dried to a desired level or after a predetermined time period, the dry cycle is finished.

In accordance with the first embodiment described above, damp air is dehumidified by using both surfaces of heat-exchanging member 47, namely, upper and lower surface 47*c* and 47*d* thereof. Thus, the dehumidification efficiency is improved, which in turn enhances the drying efficiency as well. Further, since heat exchanging path 42 is formed in an approximately U-shape by the presence of heat-exchanging member 47 disposed in the middle of heat exchanging path 42, the dry cycle can be implemented with a relatively compact structure, while effectively utilizing the limited space.

Further, since the flow directions of the cooling water and the damp air on upper surface 47*c* of heat-exchanging member 47 are opposite to each other, the cooling water is allowed to contact the damp air efficiently, thereby enhancing the overall heat exchange operation.

Moreover, the damp air is also dehumidified by the upward dispersion of cooling water through communication opening 42*c*. In other words, since dehumidification by contacting upper and lower surface 47*c* and 47*d* of heat-exchanging member 47 is complemented with dehumidification by the dispersion of cooling water, the overall drying efficiency is further improved. Hence, the resulting dry cycle becomes highly efficient.

In addition, since the damp warm air moves more slowly through upper heat exchanging path 42*b* than through communication opening 42*c*, the dispersed cooling water droplets are prevented from entering blower case 39 through air suction opening 39*a* thereof by being swept by the flow of the warm air. Instead, the cooling water falls down on heat-exchanging member 47 disposed along upper heat exchanging path 42*b*, thereby preventing water droplets from reaching heater 37. Therefore, the design of the heat exchanging path of the present invention ensures that heater 37 is operated safely without water droplets interfering with the heater operation. Accordingly, the damp air can be dehumidified efficiently and safely.

Further, since the cooling water is discharged into water tub 23 through drain hole 52 provided at the bottom portion of lower heat exchanging path 42*a* to communicate with water tub 23 and is drained out via water drain conduit 32, lint and the like stuck on heat exchanging path 42 or heat-exchanging member 47 can also be picked up by cooling water and discharged out during the dry cycle. This process prevents heat exchanging path 42 from being clogged. Therefore, the flow rate of the circulating air stays constant, thereby maintaining a stable dry process.

Second Preferred Embodiment

Figure 3:
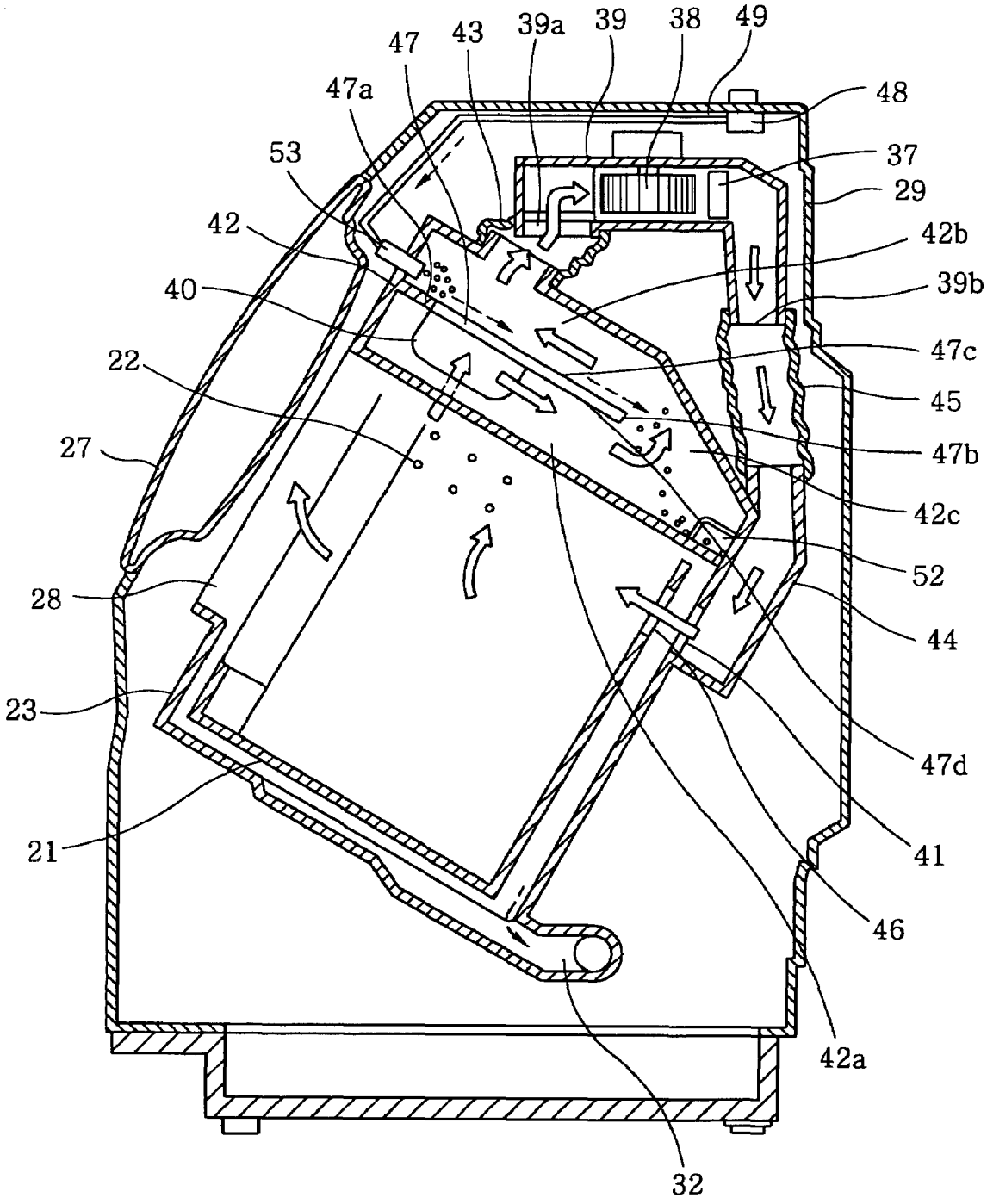
FIG. 3 provides a vertical cross sectional view of a drum type washing and drying machine in accordance with a second preferred embodiment of the present invention.
Figure 4:
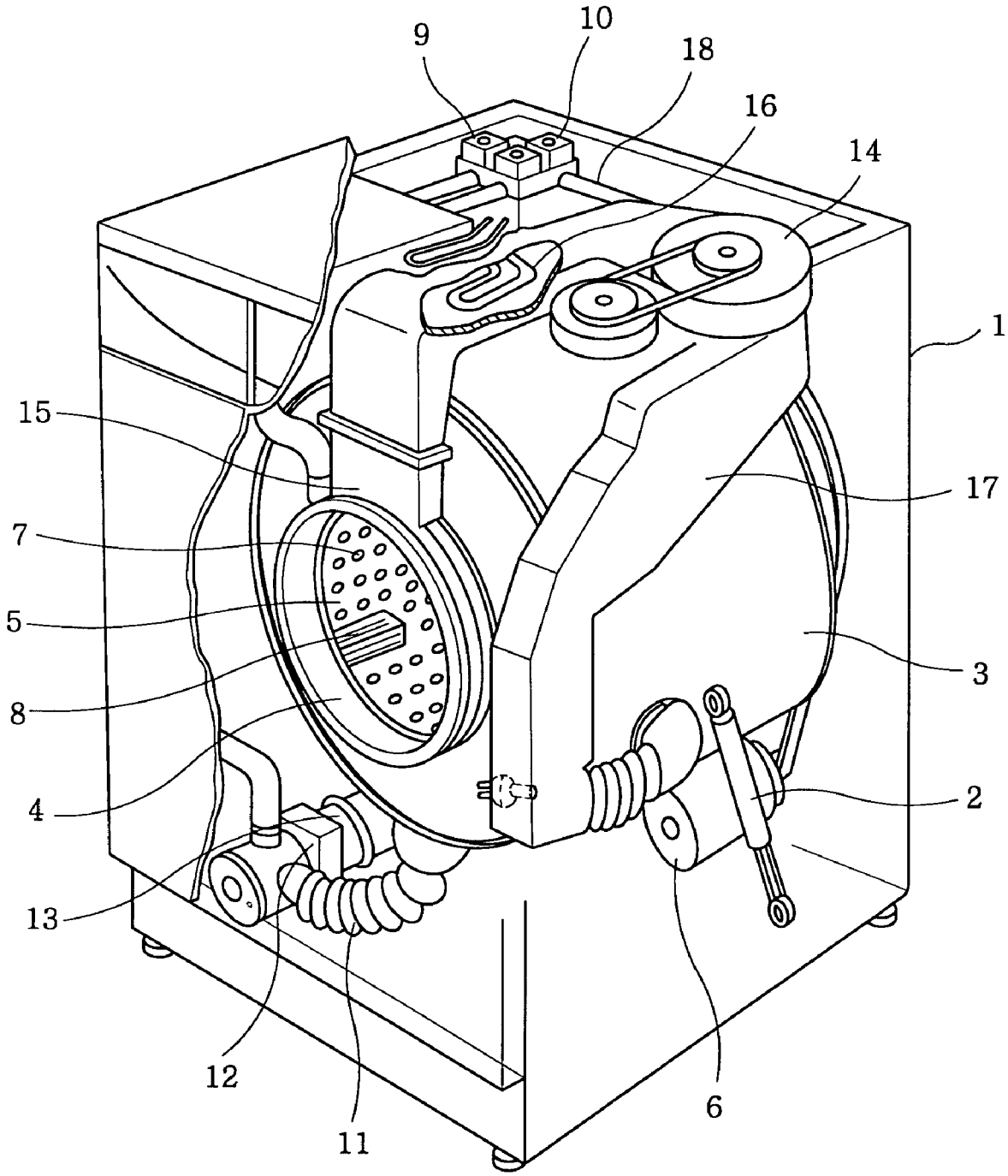
FIG. 4 (PRIOR ART)
FIG. 4 depicts a partial cross sectional perspective view of a conventional drum type washing and drying machine.

FIG. 3 shows a vertical cross sectional view of a drum type washing and drying machine in accordance with a second preferred embodiment of the present invention.

As shown in the figure, water supply nozzle 53 is disposed in the vicinity of upper end portion 47*a* of heat-exchanging member 47 within heat exchanging path 42. The other configuration of the second embodiment is identical to that of the first embodiment.

Operation of the washing machine with the above configuration will now be described. Here, basic operation in a drying process is identical to that described in the first embodiment, and description thereof will be omitted.

In this embodiment, water supply nozzle 53 is disposed in the vicinity of upper end portion 47*a* of heat-exchanging member 47 within heat exchanging path 42 such that water supply nozzle 53 is located far from the downstream end of upper heat exchanging path 42*b*. This configuration prevents cooling water from entering blower case 39 through air suction opening 39*a* of blower case 39 before flowing down on the upper surface of heat-exchanging member 47. Therefore, water droplets are prevented from reaching heater 37 during a dry cycle.

In accordance with the second embodiment of the present invention described above, water droplets are prevented from reaching heater 37, thereby ensuring a safe operation of heater 37. Thus, dehumidification of damp air can be carried out efficiently and safely.

As described above, the drum type washing and drying machine in accordance with the present invention is capable of carrying out a heat exchange operation in the compact space of the main body. Further, the present invention reduces uneven drying of laundry while improving the overall drying efficiency through a high-performance dehumidification. Therefore, the present invention can offer advantages when it is applied to a drum type washing and drying machine for performing washing, rinsing, water-extracting and drying processes sequentially in a rotary drum having an approximately horizontal or slanted rotational axis.

While the invention has been shown and described with respect to the preferred embodiments, it will be understood by those skilled in the art that various changes and modifications may be made without departing from the spirit and scope of the invention as defined in the following claims.

What is claimed is:

1. A drum type washing and drying machine comprising:

a cylindrical rotary drum provided with a plurality of drum perforations on the cylindrical surface thereof and having a rotating shaft in an approximately horizontal or slanted direction;

a water tub elastically supported in a main body of the washing and drying machine, for accommodating the rotary drum therein; and an air circulation channel comprising:

a blower unit for circulating air into the rotary drum;

a heating unit disposed between the blower unit and the rotary drum, for heating the air to be circulated into the rotary drum, wherein the air heated in the heating unit is introduced into the water tub via an inlet disposed on a rear side of the water tub;

a heat exchanging path formed as one body with the water tub and including an air flow passage for directing air, which has been exhausted from the rotary drum into a space between the water tub and the rotary drum through the drum perforations of the rotary drum, to the blower unit;

a plate-shaped heat exchanging member installed in the air flow passage; and a cooling water supply unit for supplying cooling water to the heat-exchanging member, wherein the heat-exchanging member is declined toward the rear side of the machine, in the air flow passage and has an upper and a lower surface to form an approximately U-shaped heat exchanging path;

a cross section of an upper heat exchanging path on the upper surface side of the heat-exchanging member is larger than that of a communication opening provided in the vicinity of lower end portion of the heat exchange member; and the cooling water flows in the opposite direction of the air on the upper surface side of the heat exchanging member.

2. The washing and drying machine of claim 1, wherein the cooling water from the cooling water supply unit flows down on the upper surface of the heat-exchanging member disposed in the heat exchanging path toward a lower end portion of the heat-exchanging member.

3. The washing and drying machine of claim 2, wherein the cooling water is dispersed by the circulating air at the lower end portion of the heat-exchanging member.

4. The washing and drying machine of claim 3, wherein a drain hole for discharging the cooling water into the water tub, the cooling water being supplied to the heat-exchanging member by the cooling-water supply unit, is provided at a bottom portion of the heat exchanging path.

5. The washing and drying machine of claim 3, wherein a water supply nozzle for supplying the cooling water to the heat-exchanging member from the cooling water supply unit is provided in the vicinity of the upper end portion of the heat-exchanging member within the heat exchanging path.

6. The washing and drying machine of claim 2, wherein a drain hole for discharging the cooling water into the water tub, the cooling water being supplied to the heat-exchanging member by the cooling-water supply unit, is provided at a bottom portion of the heat exchanging path.

7. The washing and drying machine of claim 2, wherein a water supply nozzle for supplying the cooling water to the heat-exchanging member from the cooling water supply unit is provided in the vicinity of the upper end portion of the heat-exchanging member within the heat exchanging path.

8. The washing and drying machine of claim 1, wherein a drain hole for discharging the cooling water into the water tub, the cooling water being supplied to the heat-exchanging member by the cooling-water supply unit, is provided at a bottom portion of the heat exchanging path.

9. The washing and drying machine of claim 1, wherein a water supply nozzle for supplying the cooling water to the heat-exchanging member from the cooling water supply unit is provided in the vicinity of the upper end portion of the heat-exchanging member within the heat exchanging path.

* * * * *